US008185984B2

(12) United States Patent
Meehan et al.

(10) Patent No.: US 8,185,984 B2
(45) Date of Patent: May 29, 2012

(54) SPOUT MOUNTING ASSEMBLY

(75) Inventors: Steven Kyle Meehan, Fishers, IN (US); Darrell Scott Crowe, Lebanon, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 550 days.

(21) Appl. No.: 12/356,021

(22) Filed: Jan. 19, 2009

(65) Prior Publication Data

US 2010/0180375 A1 Jul. 22, 2010

(51) Int. Cl.
*E03C 1/042* (2006.01)

(52) U.S. Cl. ..... 4/695; 137/801; 4/675

(58) Field of Classification Search ..... 4/675–678, 4/695; 137/801, 312.12, 315.11; 239/279, 239/280, 280.5, 282, 283, 587.1; 222/180
See application file for complete search history.

(56) References Cited

U.S. PATENT DOCUMENTS

| | | | | |
|---|---|---|---|---|
| 4,037,624 | A | 7/1977 | Turner et al. | |
| 4,186,761 | A | 2/1980 | Guarnieri | |
| 4,667,987 | A | 5/1987 | Knebel | |
| 5,232,008 | A | 8/1993 | Jeffries et al. | |
| 5,458,154 | A | 10/1995 | Niemann et al. | |
| 5,669,417 | A | 9/1997 | Lian-Jie | |
| 5,873,387 | A | 2/1999 | Weber et al. | |
| 6,014,985 | A | 1/2000 | Warshawsky | |
| 6,209,153 | B1 | 4/2001 | Segien, Jr. | |
| 6,370,712 | B1 | 4/2002 | Burns et al. | |
| 6,385,794 | B1 * | 5/2002 | Miedzius et al. | 4/620 |
| 6,385,798 | B1 | 5/2002 | Burns et al. | |
| 6,434,765 | B1 | 8/2002 | Burns et al. | |
| 6,619,320 | B2 | 9/2003 | Parsons | |
| 6,659,124 | B2 * | 12/2003 | Burns et al. | 137/359 |
| 6,729,349 | B2 | 5/2004 | Brandebusemeyer | |
| 6,874,527 | B2 | 4/2005 | Meeder | |
| 6,962,168 | B2 | 11/2005 | McDaniel et al. | |
| 7,150,293 | B2 | 12/2006 | Jonte et al. | |
| 7,174,577 | B2 | 2/2007 | Jost et al. | |
| 7,175,158 | B2 | 2/2007 | Thomas | |
| 7,415,991 | B2 | 8/2008 | Meehan et al. | |
| 7,537,023 | B2 | 5/2009 | Marty et al. | |
| 7,631,372 | B2 * | 12/2009 | Marty et al. | 4/623 |
| 7,690,395 | B2 | 4/2010 | Jonte et al. | |
| 7,832,428 | B2 * | 11/2010 | Leutwyler | 137/801 |
| 7,896,025 | B2 * | 3/2011 | Hanson | 137/454.6 |
| 2003/0213062 | A1 | 11/2003 | Honda et al. | |
| 2005/0155988 | A1 * | 7/2005 | Meehan et al. | 222/321.7 |
| 2006/0124183 | A1 | 6/2006 | Kuo | |
| 2006/0157127 | A1 | 7/2006 | Bars et al. | |
| 2006/0157128 | A1 | 7/2006 | Frackowiak et al. | |
| 2006/0202142 | A1 * | 9/2006 | Marty et al. | 251/129.04 |
| 2006/0283511 | A1 | 12/2006 | Nelson | |
| 2007/0031624 | A1 | 2/2007 | Brosius | |

(Continued)

FOREIGN PATENT DOCUMENTS

WO WO 2009/158498 12/2009

*Primary Examiner* — Brian Glessner
*Assistant Examiner* — Brian D Mattei
(74) *Attorney, Agent, or Firm* — Faegre Baker Daniels

(57) ABSTRACT

A faucet spout mounting assembly includes a mounting hub, a spout supported for rotation relative to the mounting hub, a retaining member configured to restrain axial movement of the spout relative to the mounting hub, and a biasing member configured to provide an axial load between the spout and the mounting hub.

28 Claims, 11 Drawing Sheets

U.S. PATENT DOCUMENTS

2007/0137714 A1 6/2007 Meehan et al.
2007/0295418 A1* 12/2007 Leutwyler ..... 137/615
2008/0099091 A1 5/2008 Benstead
2008/0178935 A1 7/2008 Thomas
2008/0178954 A1 7/2008 Pinette et al.
2008/0185060 A1 8/2008 Nelson
2008/0308165 A1* 12/2008 Meehan et al. ..... 137/801
2009/0000026 A1* 1/2009 Hanson ..... 4/695
2009/0276954 A1* 11/2009 Davidson ..... 4/695

* cited by examiner

SPOUT MOUNTING ASSEMBLY

BACKGROUND AND SUMMARY OF THE INVENTION

The present invention relates generally to faucets and, more particularly, to a spout mounting assembly for coupling faucet spouts to a mounting deck, such as a wash basin or sink deck.

Many faucets include a spout coupled to a mounting deck for dispensing water into a sink. Often, particularly in kitchen faucets, the spout is rotatably supported to supply water to different desired locations, for example, to multiple sink basins.

It would be advantageous for a mounting assembly for a rotatable faucet spout to reduce the number of components, simplify assembly, rotate smoothly, include rotational limit stops, reduce undesired wobble of the spout, and eliminate visible above deck couplers.

According to an illustrative embodiment of the present disclosure, a spout mounting assembly includes a mounting hub defining a longitudinal axis and a spout supported for rotation relative to the mounting hub. A retaining member is operably coupled to the spout and to the mounting hub. The retaining member is configured to restrain axial movement of the spout relative to the mounting hub. A biasing member is operably coupled to the spout and to the mounting hub. The biasing member is configured to provide an axial load between the spout and the mounting hub.

According to a further illustrative embodiment of the present disclosure, a spout mounting assembly includes a mounting hub defining a longitudinal axis, and a spout supported for rotation relative to the mounting hub. The spout includes a passageway extending between an inlet end and an outlet end, and a mounting member at the inlet end. A retaining member is operably coupled to the mounting member of the spout and to the mounting hub. The retaining member is configured to restrain axial movement of the spout relative to the mounting hub. The retaining member includes opposing first and second ends, a first resilient coupler supported at the first end and configured to releasably couple with the mounting hub, and a second resilient coupler supported at the second end and configured to releasably couple with the mounting member of the spout.

According to another illustrative embodiment of the present disclosure, a spout mounting assembly includes a mounting hub defining a longitudinal axis, and a spout supported for rotation relative to the mounting hub. A biasing member is operably coupled to the spout and to the mounting hub. The biasing member is configured to provide an axial load between the spout and the mounting hub. The mounting hub and the spout include opposing engagement surfaces extending substantially perpendicular to the longitudinal axis. The biasing member includes a body portion supporting at least one resilient arm extending between the engagement surface of the mounting hub and the engagement surface of the spout.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiment selected for description have been chosen to enable one skilled in the art to practice the invention.

Figure 1:
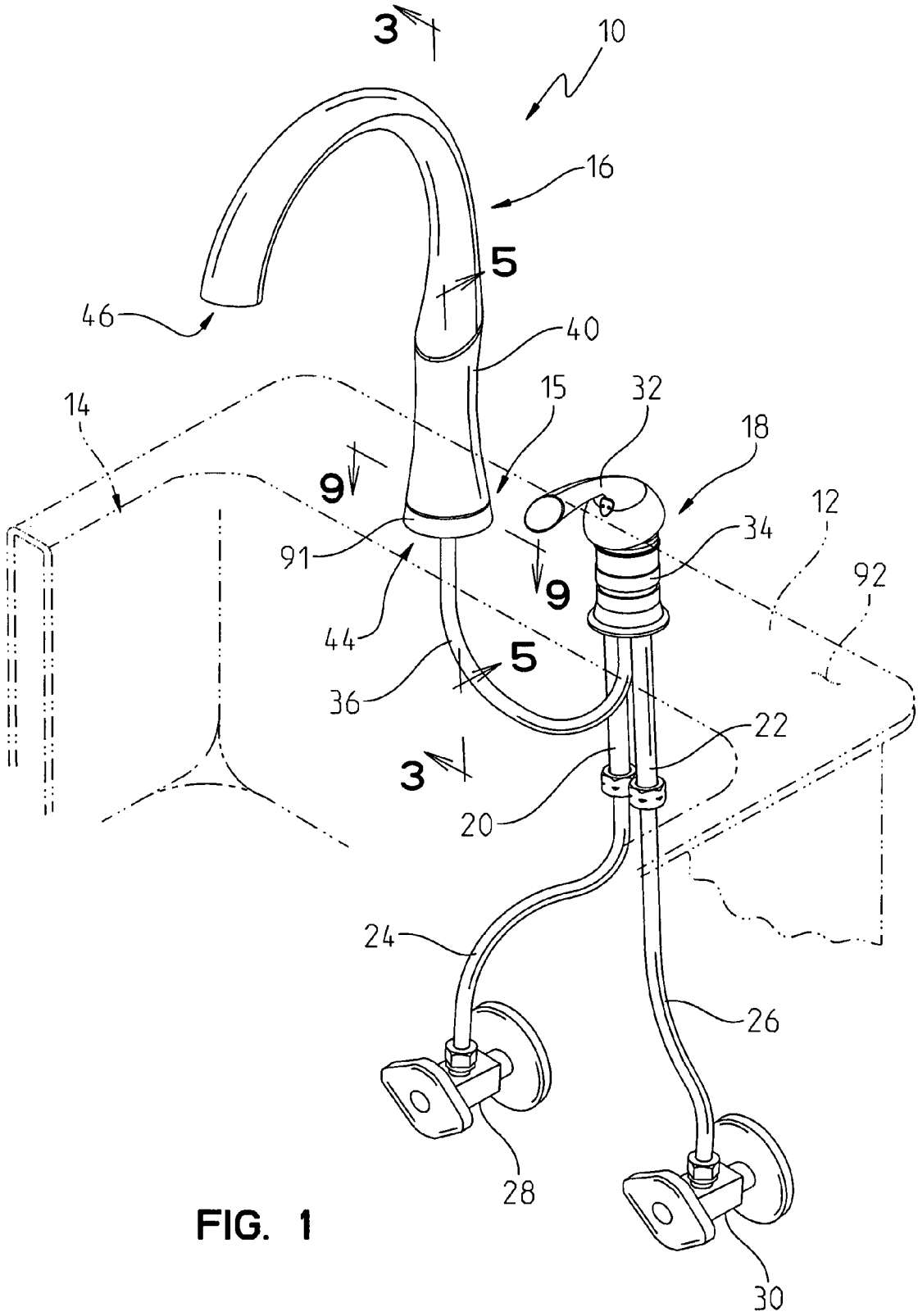
FIG. 1 is a perspective view of an illustrative faucet assembly mounted to a sink deck.

With reference initially to FIG. 1, an illustrative faucet assembly 10 is shown coupled to a mounting deck 12 adjacent a sink basin 14, and including a spout mounting assembly 15 rotatably supporting a delivery spout 16. Illustratively the delivery spout 16 is fluidly coupled to a valve assembly 18. The valve assembly 18 may be of conventional design and includes a hot water inlet conduit 20 and a cold water inlet conduit 22. Conventional fluid couplings 24 and 26 illustratively fluidly couple the hot water inlet conduit 20 and the cold water inlet conduit 22 to a hot water supply, such as a conventional hot water stop 28, and a conventional cold water supply, such as a conventional cold water stop 30. The valve assembly 18 illustratively includes a handle 32 operably coupled to a mixing valve 34 which controls the flow rate of water from the hot water supply conduit 20 and the cold water supply conduit 22 to a mixed water outlet conduit 36. As further detailed herein, the mixed water outlet conduit 36 illustratively extends to the spout 16.

While the spout mounting assembly 15 of the present disclosure is shown for use with a conventional kitchen faucet assembly 10, it should be appreciated that it may be used with other faucet assemblies, including lavatory faucets and roman tub faucets. Furthermore, while the illustrative valve assembly 18 is a conventional mixing valve, other control valves may be substituted therefor, such as independent hot and cold water control valves (not shown).

Figure 2:
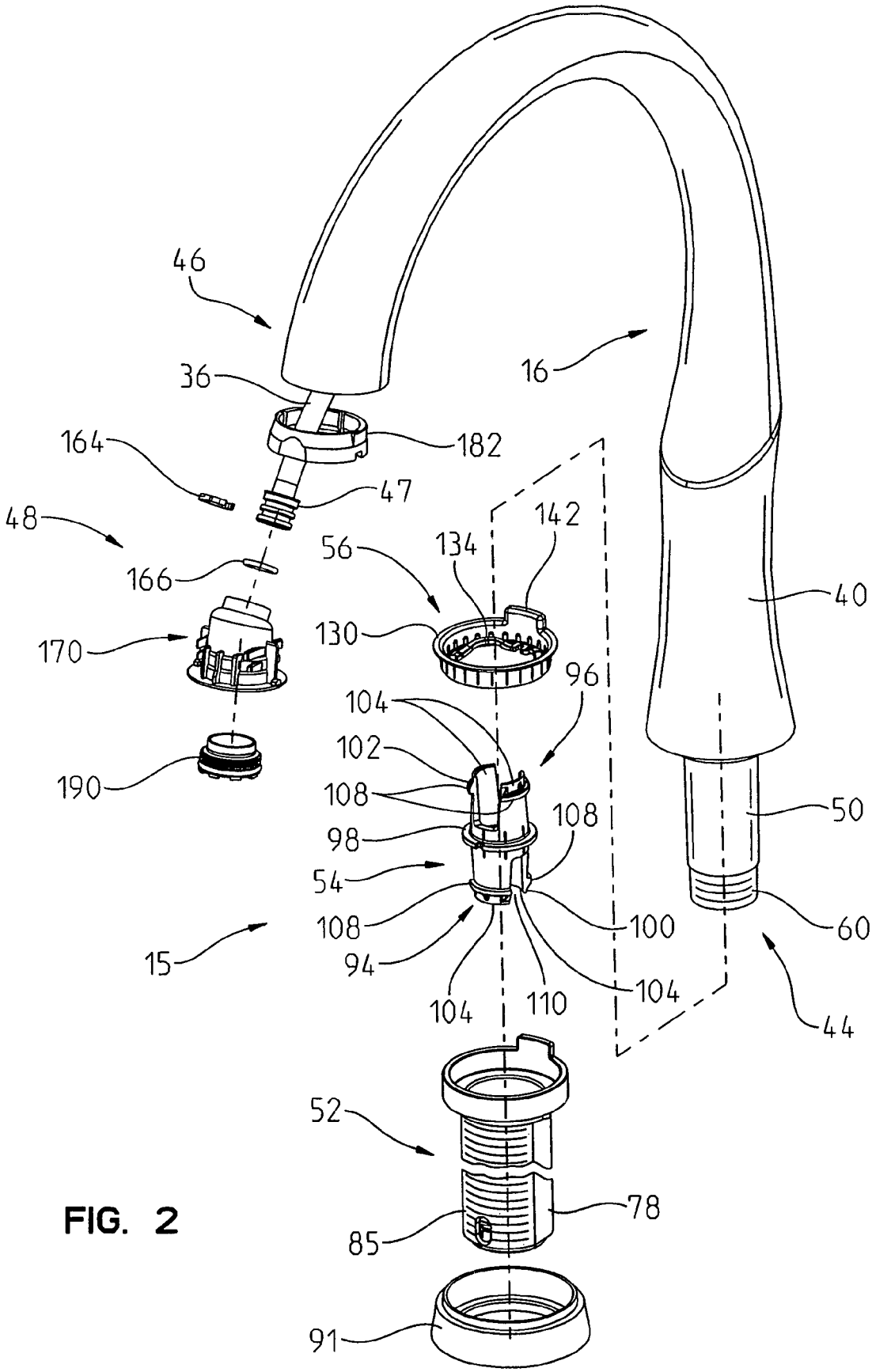
FIG. 2 is an exploded perspective view of the spout mounting assembly and spout outlet coupling of FIG. 1.
Figure 3:
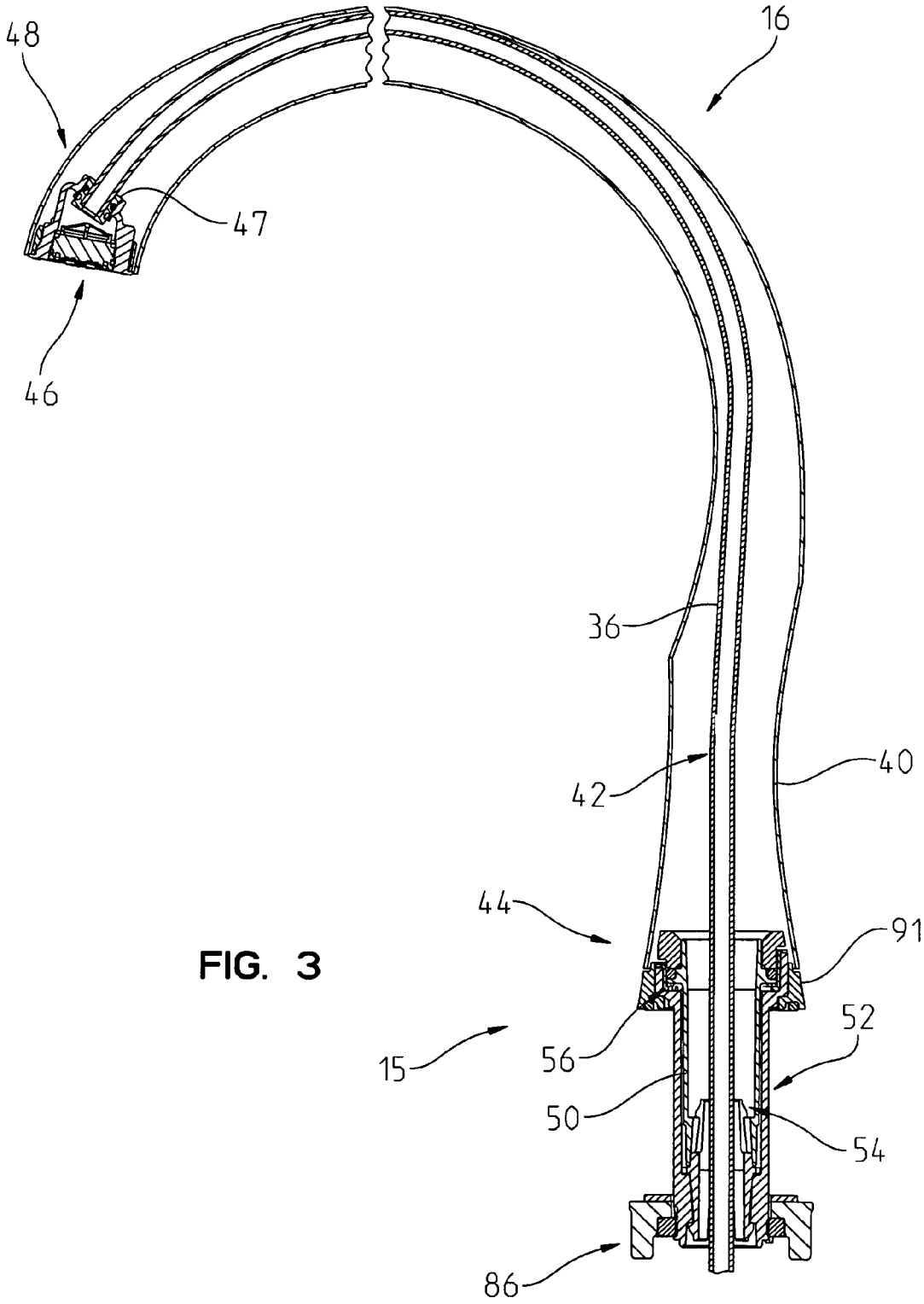
FIG. 3 is a cross-sectional view taken along line 3-3 of FIG. 1

With reference now to FIGS. 1-3, the spout 16 illustratively includes a tubular body 40 defining a passageway 42 extending between an inlet end 44 and an outlet end 46. The outlet conduit 36 is received within the passageway 42 and has a tip 47 secured to the outlet end 46 of the tubular body 40 by an outlet coupling 48. A mounting member 50 is illustratively supported at the inlet end 44 of the tubular body 40. A mounting hub 52 is coupled to the mounting deck 12 and illustratively receives the mounting member 50 of the spout 16. A retaining member 54 axially couples the spout 16 to the mounting hub 52, while a biasing member 56 provides an axial load between the spout 16 and the mounting hub 52.

The tubular body 40 of spout 16 may be formed of a rigid material, such as brass, steel, a rigid polymer, or a rigid ceramic. The outlet conduit 36 illustratively includes a tubular body 58 formed of a flexible polymer, such as a cross-linked polyethylene (PEX).

With reference to FIGS. 4-7 and 9, the mounting member 50 illustratively comprises a hollow tube 60 threadably received within an insert 62 support at the inlet end 44 of the spout 16. The insert 62 illustratively includes internal threads 64 for receiving external threads 66 of the mounting member 50. Both the mounting member 50 and the insert 62 are illustratively formed of a rigid material, such as brass. The mounting member 50 may be secured to the tubular body 40 of spout 16 through conventional means, such as brazing. A resilient o-ring 68 is illustratively positioned within a groove 70 of the mounting member 50, intermediate an annular flange 72 of the mounting member 50 and an annular wall 74 of the insert 62. In alternative embodiments, the insert 62 and/or the mounting member 50 may be integrally formed, for example through forging, with the tubular body 40 of the spout 16.

Figure 4:
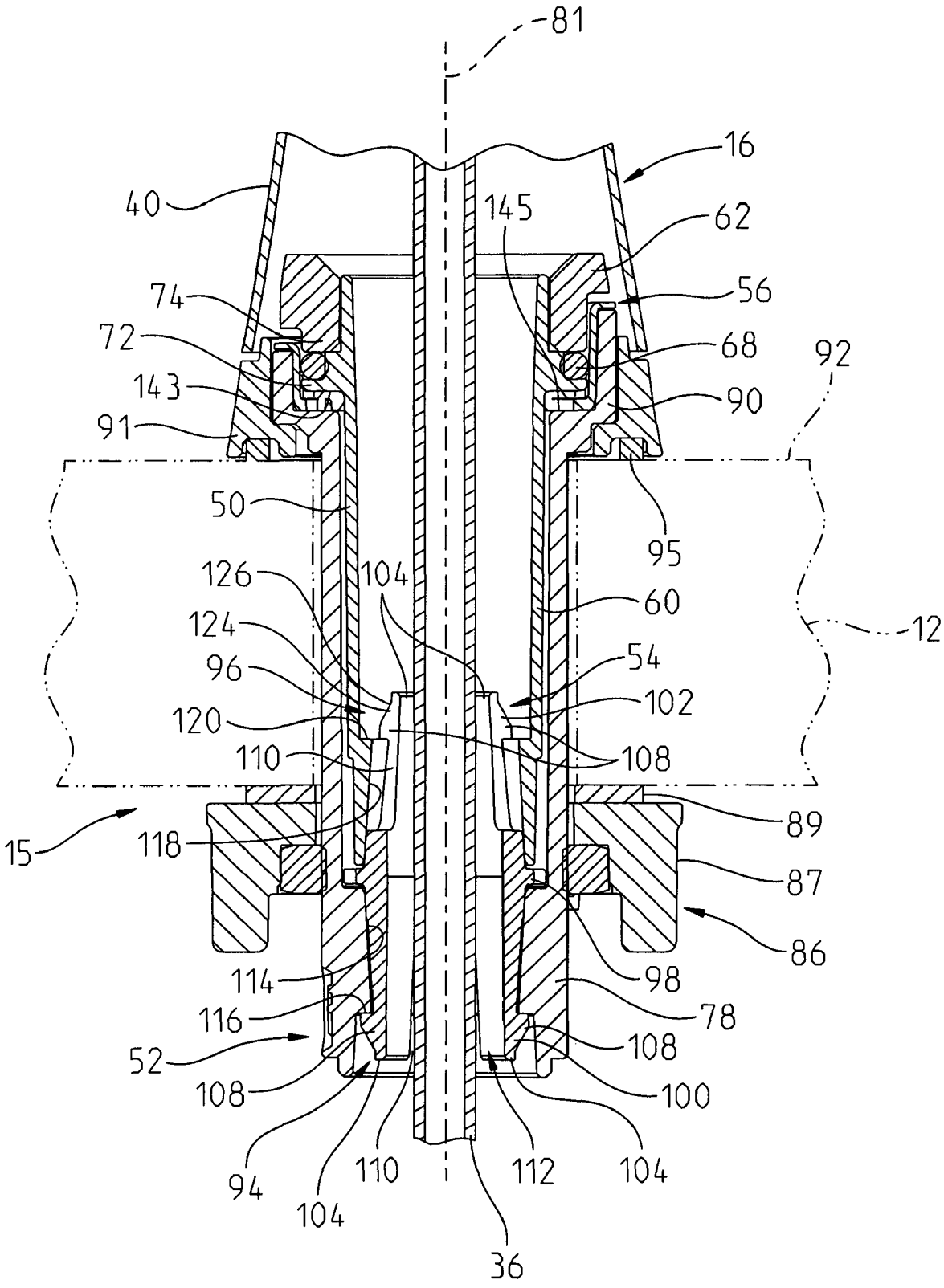
FIG. 4 is a detailed view of the spout mounting assembly of FIG. 3.
Figure 5:
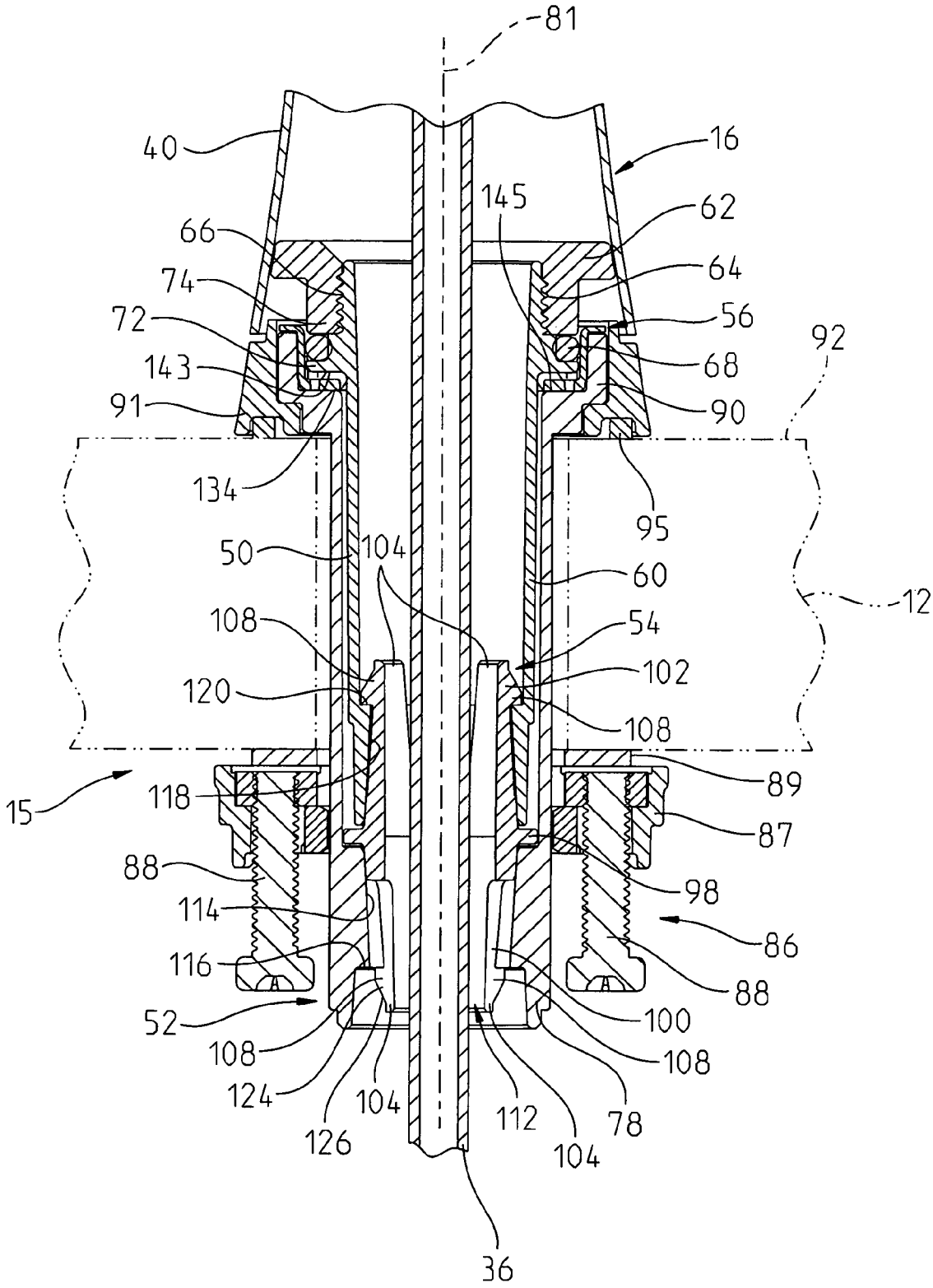
FIG. 5 is a detailed view similar to FIG. 4, taken along line 5-5 of FIG. 1.
Figure 6:
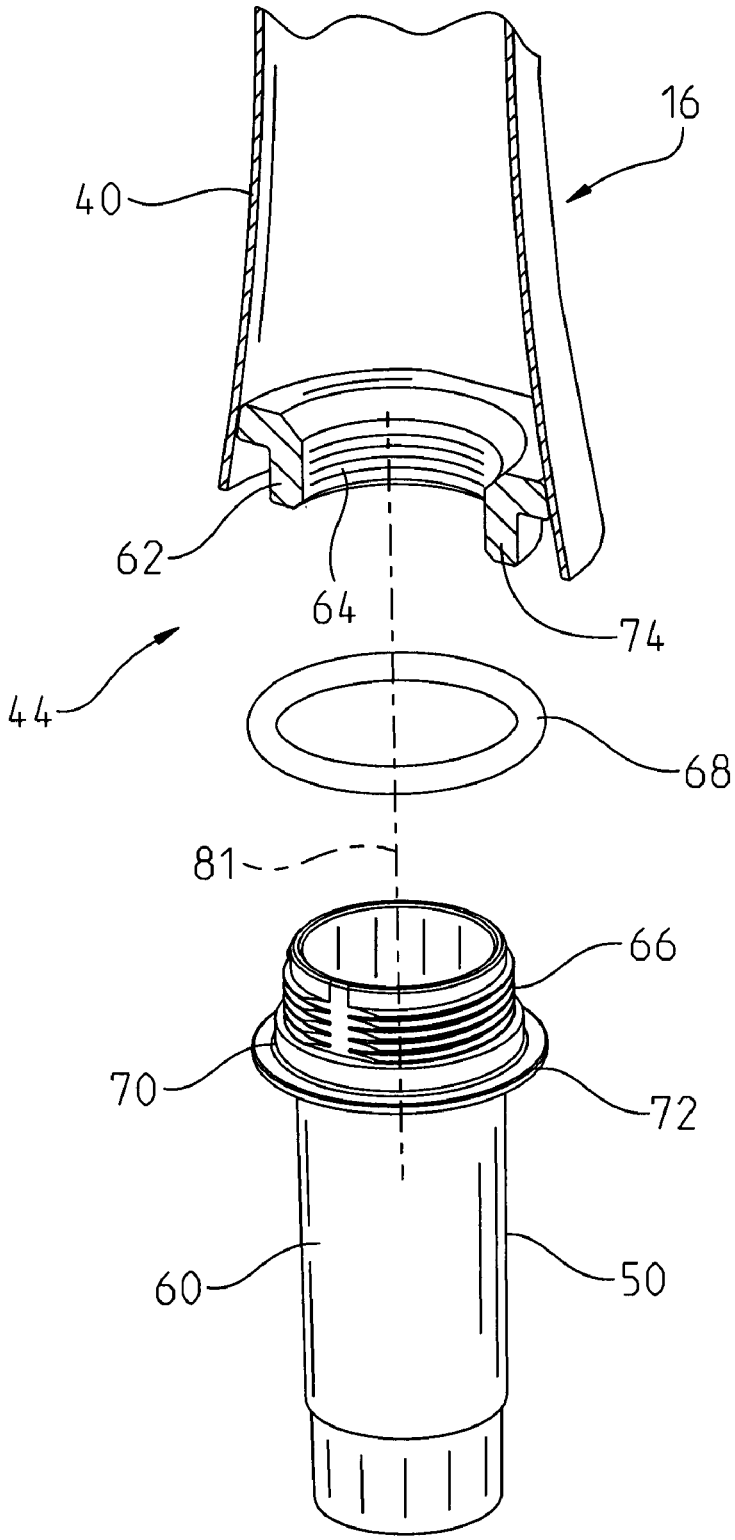
FIG. 6 is an exploded perspective view, in partial section, showing the inlet end of the spout of FIG. 1.

With reference to FIGS. 4, 5, 7, and 8, the mounting hub 52 illustratively includes a tubular body or mounting shank 78 having an internal cavity 80 defining a longitudinal axis 81 and extending between first and second ends 82 and 84 (illustratively lower and upper ends, respectively). A plurality of external threads 85 extend upwardly from the first end 82 and are configured to cooperate with a mounting nut assembly 86. The mounting nut assembly 86 includes a body 87 configured to threadably engage the threads 85 of the mounting hub 52 and support a pair of jack screws 88 (FIG. 5). Second or upper end 84 of the mounting hub 52 includes an enlarged head 90 which is supported on an upper surface 92 of the mounting deck 12. More particularly, the mounting deck 12 is illustratively captured intermediate the mounting nut assembly 86 and the enlarged head 90 of the mounting hub 52. The jack screws 88 are configured to be tightened against a washer 89 to assist in tightening the spout mounting assembly 15 against the mounting deck 12.

Figure 8:
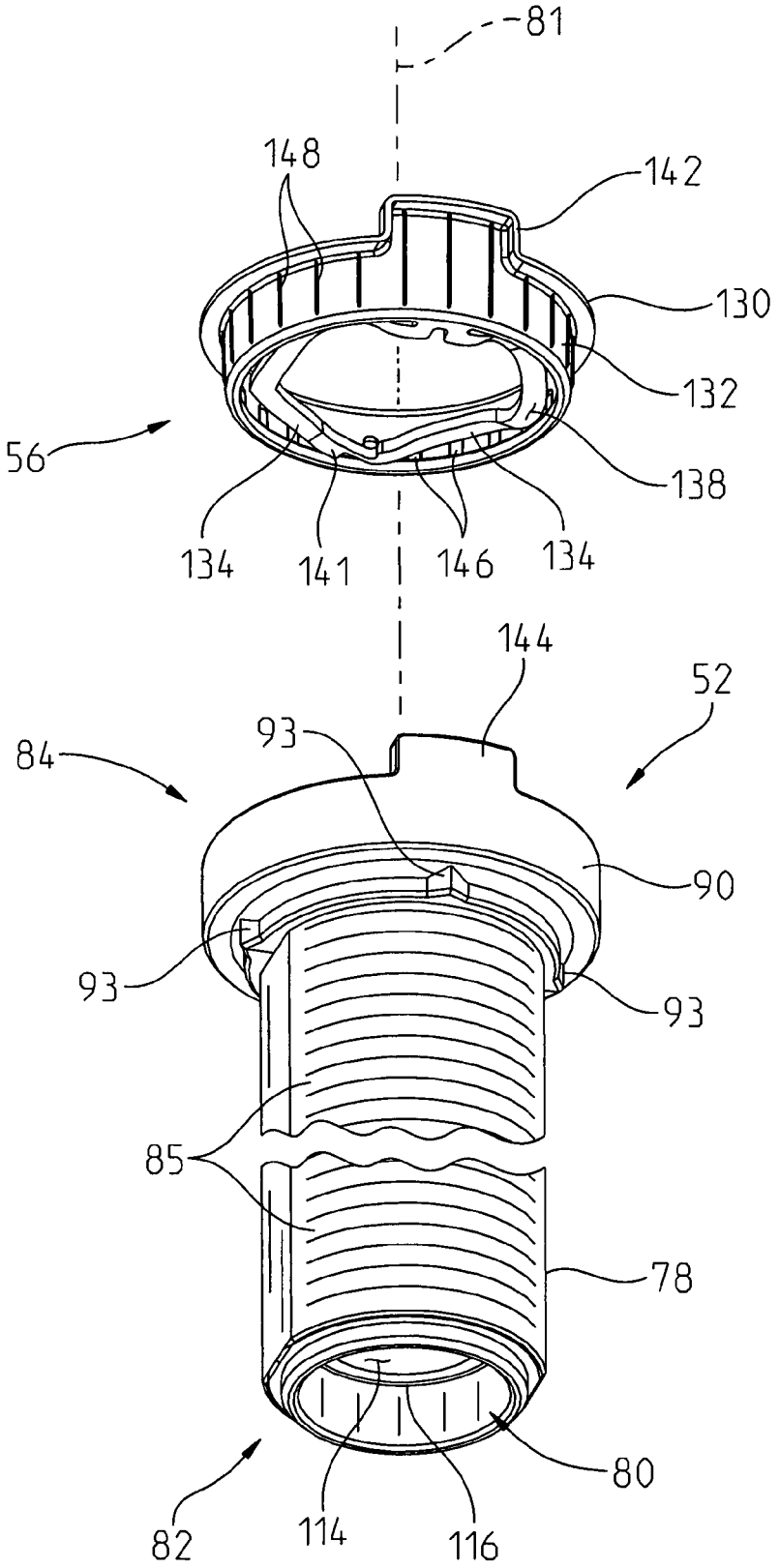
FIG. 8 is an exploded perspective view of the mounting hub and biasing member.

In certain illustrative embodiments as shown in FIGS. 1-5, a base 91 may be positioned below the tubular body 40 of the spout 16, intermediate the enlarged head 90 of the mounting hub 52 and the upper surface 92 of the mounting deck 12. As shown in FIG. 8, a plurality of protrusions 93 may be supported by the mounting hub 52 for receipt within corresponding apertures (not shown) in the base 91 to rotationally locate or key the base 91 relative to the spout 16. A gasket 95 may also be supported by the mounting deck 12 below the base 91. The mounting member 50 of the spout 16 is concentrically received within the internal cavity 80 of the mounting hub 52 and is configured to rotate about the longitudinal axis 81. As such, the outlet end 46 of the spout 16 may be rotated to a position desired by the user. The retaining member 54 is also received within the internal cavity 80 of the mounting hub 52 and is configured to axially (e.g. vertically) restrain the spout 16 relative to the mounting hub 52.

Referring now to FIGS. 2, 4, and 5, the retaining member 54 illustratively includes opposing first and second ends 94 and 96 (illustratively lower and upper ends) separated by an annular center flange 98. A first resilient coupler 100 is supported proximate the first end 94 and is configured to releasably couple with the mounting hub 52. A second resilient coupler 102 is supported proximate the second end 96 and is configured to releasably couple with the mounting member 50 of the spout 16. Each resilient coupler 100 and 102 is illustratively structurally identical such that the retaining member 54 is symmetrical about the center flange 98 for ease of assembly. More particularly, each resilient coupler 100 and 102 includes a pair of opposing arms 104 including retaining lips 108. The arms 104 are separated by slots 110 and, together with the center flange 98, define a cylindrical passageway 112 for receiving the outlet conduit 36. Illustratively, the retaining member 54 is formed of a polymer, such as Celcon®, an acetal copolymer available from Ticona of Florence, Ky.

With further reference to FIGS. 4 and 5, the mounting hub 52 includes an internal ramp surface 114 defining an annular locking ridge 116 proximate the first or lower end 94 thereof. Similarly, the mounting member 50 of the spout 16 includes an inclined ramp surface 118 defining an annular locking ridge 120 proximate the first or lower end 122 thereof. The retaining lips 108 of the first resilient coupler 100 are configured to releasably engage with the locking ridge 116 of the mounting hub 52. Similarly, the retaining lips 108 of the second resilient coupler 102 are configured to releasably engage with the locking ridge 120 of the mounting member 50 of the spout 16.

Support ribs 124 are positioned adjacent the lips 108 of the first and second couplers 100 and 102. The ribs 124 include angled surfaces 126 that, during assembly, are configured to cooperate with the ramp surfaces 114 and 118 for forcing the arms 104 radially inwardly as the couplers 100 and 102 move axially relative to the mounting hub 52 and the mounting member 50 of the spout 16, respectively. Moreover, the respective ramp surfaces 114 and 118 of the mounting hub 52 and the mounting member 50 are configured to aid in assembly by forcing the resilient arms 104 radially inwardly as the retaining member 54 is moved in an axial direction toward the first end 82 of the mounting hub 52 (e.g., downwardly in FIGS. 3 and 4), and by forcing the resilient arms 104 radially inwardly as the mounting member 50 of the spout 16 is moved in an axial direction toward the first end 82 of the mounting hub 52.

Figure 7:
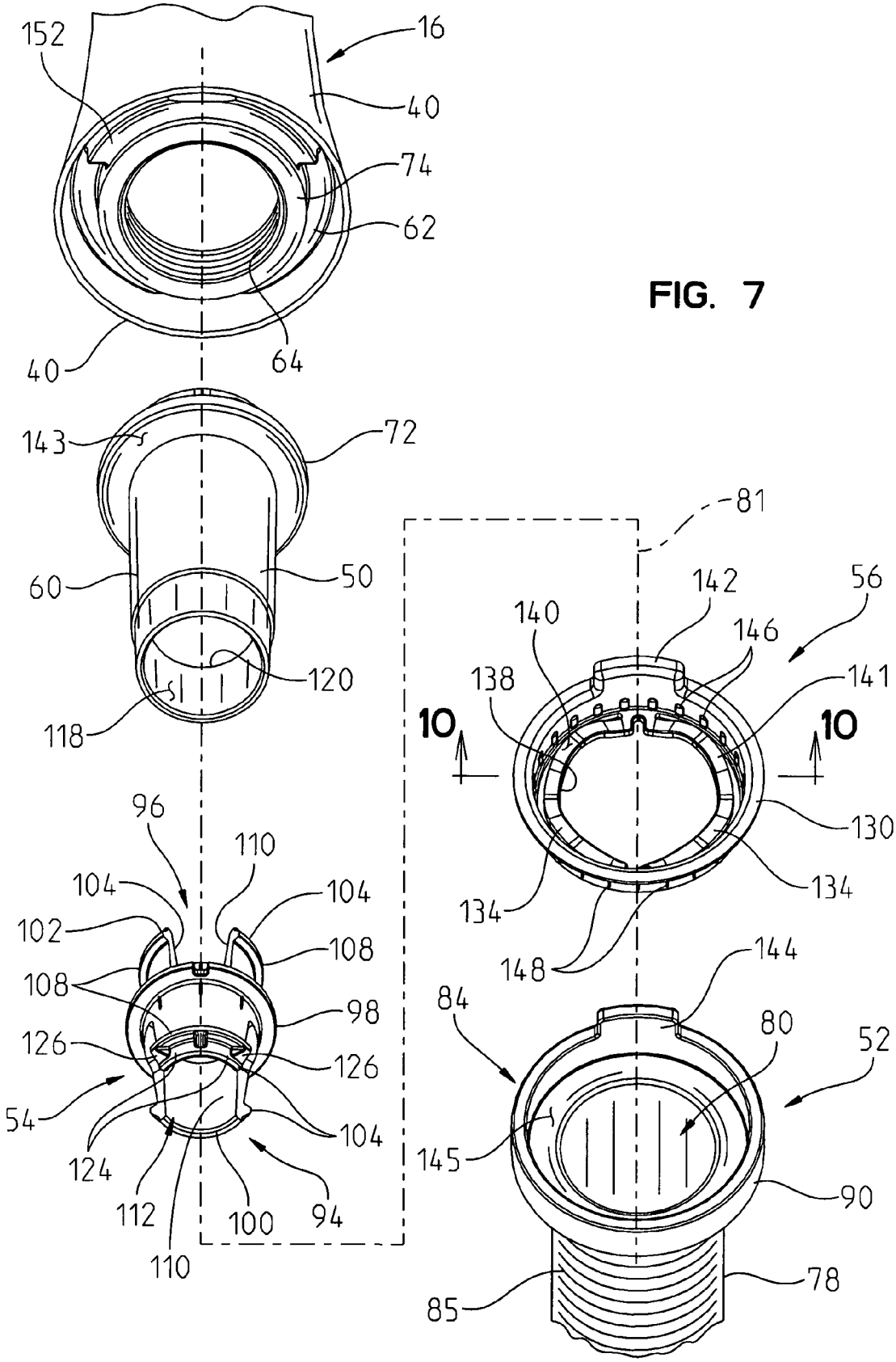
FIG. 7 is an exploded perspective view showing the retaining member and the biasing member positioned intermediate the spout and mounting hub, with the spout and the retaining member tilted forward relative to the biasing member and the mounting hub.
Figure 10:
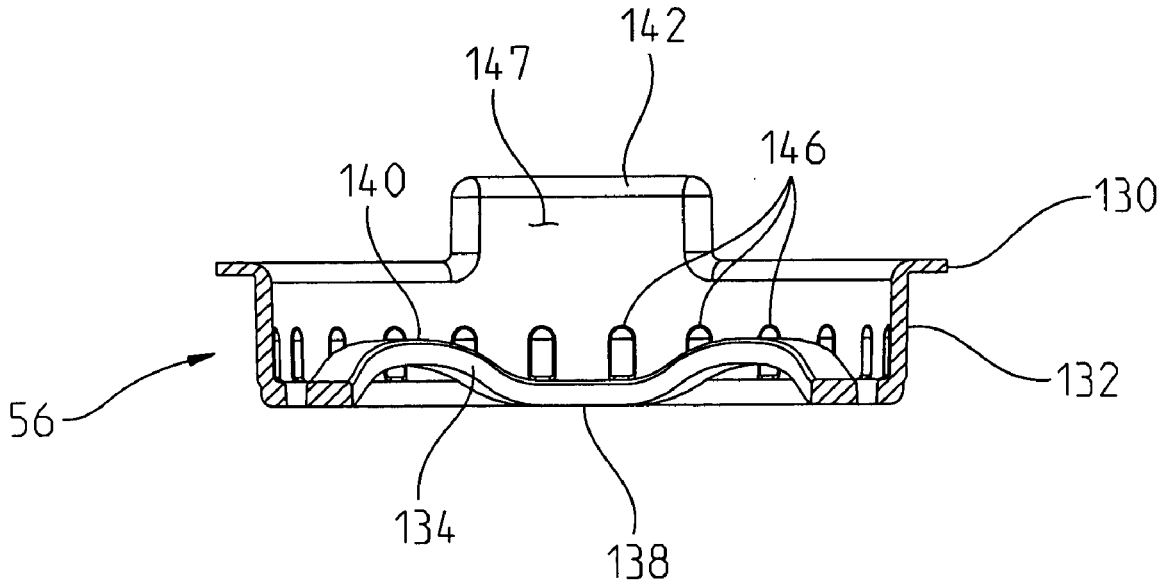
FIG. 10 is a cross-sectional view taken along line 10-10 of FIG. 7.

With reference to FIGS. 7, 8, and 10, the biasing member 56 illustratively includes a body portion 130 including an annular mounting ring 132 operably coupled to the mounting hub 52 for providing an axial load between the spout 16 and the mounting hub 52. More particularly, the mounting ring 132 of the biasing member 56 supports a pair of resilient arms 134 having an arcuate wavelike configuration extending between first and second biasing surfaces 138 and 140 (FIG. 10). The resilient arms 134 may be connected at opposing ends to define an annular biasing ring 141 concentric to the mounting ring 132.

The resilient arms 134 create an axial or vertical load between the spout 16 and the mounting hub 52 within the dimensional tolerance ranges of the spout mounting assembly 15. More particularly, the annular flange 72 of the mounting member 50 of the spout 16 includes an engagement surface 143 extending perpendicular to the longitudinal axis 81. Likewise, the enlarged head 90 of the mounting hub 52 includes an engagement surface 145 extending perpendicular to the longitudinal axis 81. The engagement surfaces 143 and 145 face each other and the resilient arms 134 of the biasing member 56 are spaced therebetween. Moreover, the second biasing surfaces 140 of the resilient arms 134 bias the engagement surface 143, and hence the spout 16, away from the mounting hub 52 since the first biasing surfaces 138 of the resilient arms 134 provide a reaction force against the engagement surface 145. The retaining member 54 is axially compliant in that it provides for limited axial movement of the spout 16 relative to the mounting hub 52 until the biasing member 56 causes the resilient couplers 100 and 102 of the retaining member 54 to engage the respective locking ridges 116 and 120 of the mounting hub 52 and mounting member 50 of the spout 16.

The biasing member 56 further includes a locating member 142 configured to partially receive an axially extending tab 144 supported by the mounting hub 52 to provide for proper rotational orientation of the biasing member 56 relative to the mounting hub 52, and to prevent direct metal-to-metal contact between the spout 16 and the mounting hub 52. A plurality of inner ribs 146 extend radially inwardly from the mounting ring 132 and are configured to cooperate with the outer diameter of the annular flange 72 of the mounting member 50. The o-ring 68 is supported by the mounting member 50 and cooperates with an inner surface 147 (FIG. 10) of the mounting ring 132 of the biasing member 50 to reduce wobble and provide limited frictional resistance during rotation of the spout 16 relative to the mounting hub 52. A plurality of outer ribs 148 extend radially outwardly from the mounting ring 132 and are configured to cooperate with the enlarged head 90 of the mounting hub 52 to again reduce wobble and assist in securing the retaining member 54 to the mounting hub 52. Illustratively, the biasing member 56 is formed of a polymer, such as the acetal copolymer Celcon®.

Figure 9:
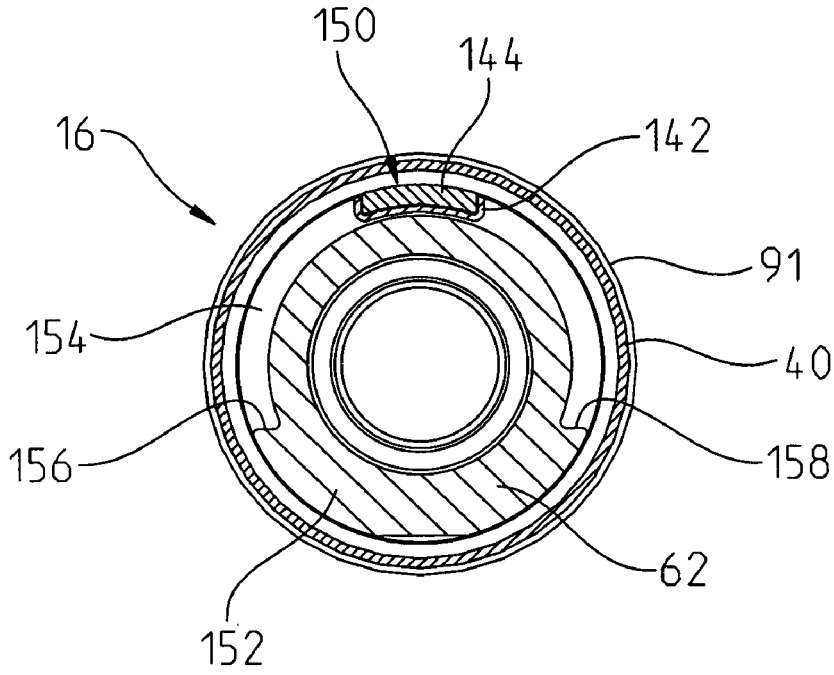
FIG. 9 is a cross-sectional view taken along line 9-9 of FIG. 1.

With reference to FIGS. 7-9, the tab 144 of the mounting hub 52 and the locating member 142 of the biasing member 56 define a limit member 150 configured to cooperate with a stop member 152 supported by the insert 62. More particularly, the limit member 150 and the stop member 152 cooperate to limit rotational movement of the spout 16 about longitudinal axis 81. Illustratively, the limit member 150 is received within an arcuate groove 154 defined intermediate the insert 62 and the body 40 of the spout 16. As the spout 16 is rotated about longitudinal axis 81, the groove 154 moves relative to the limit member 150 until one of the opposing edges 156 and 158 of the stop member 152 engages the limit member 150. As may be appreciated, the extent of desired rotation may be varied by changing the arcuate length of the limit member 150 or the stop member 152. In the illustrative embodiment, rotation of the spout 16 is limited to approximately 180 degrees.

Figure 11:
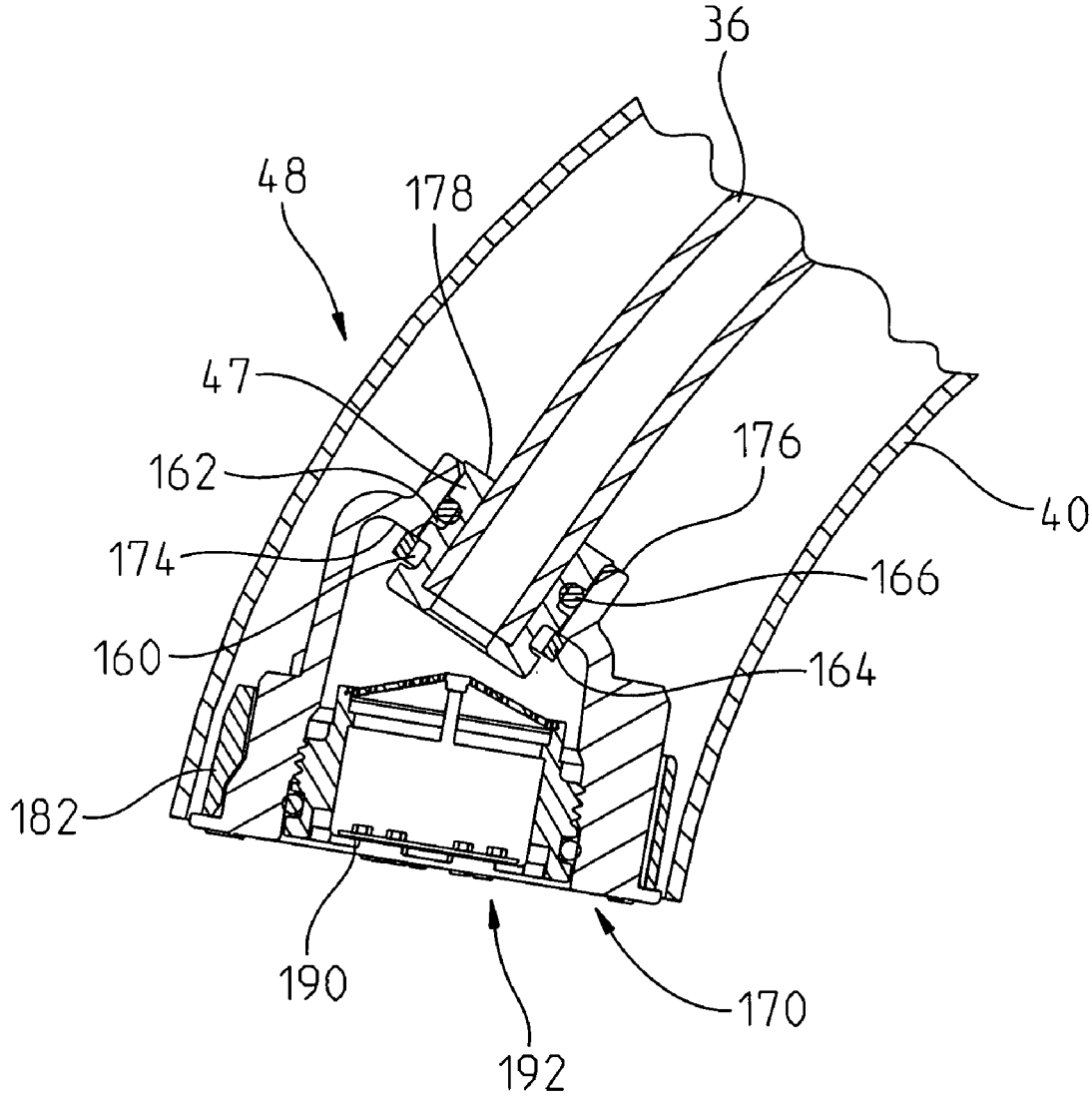
FIG. 11 is a detailed view of the outlet coupling of the spout of FIG. 3.
Figure 12:
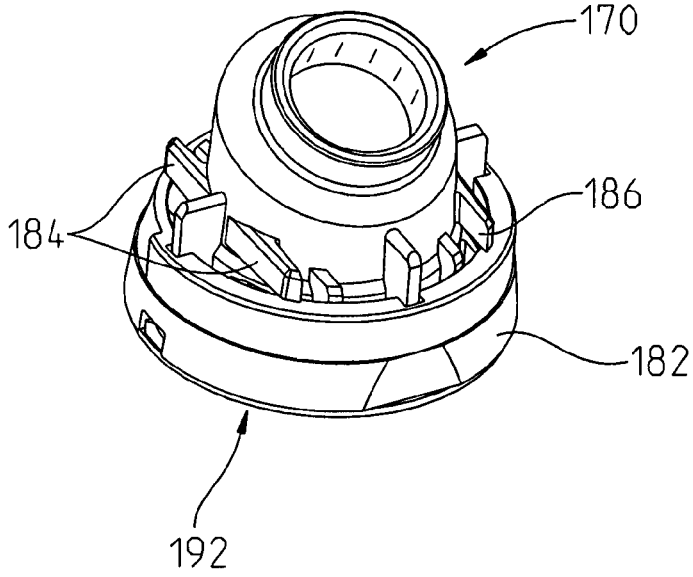
FIG. 12 is partial perspective view of the outlet coupling of FIG. 11.
Figure 13:
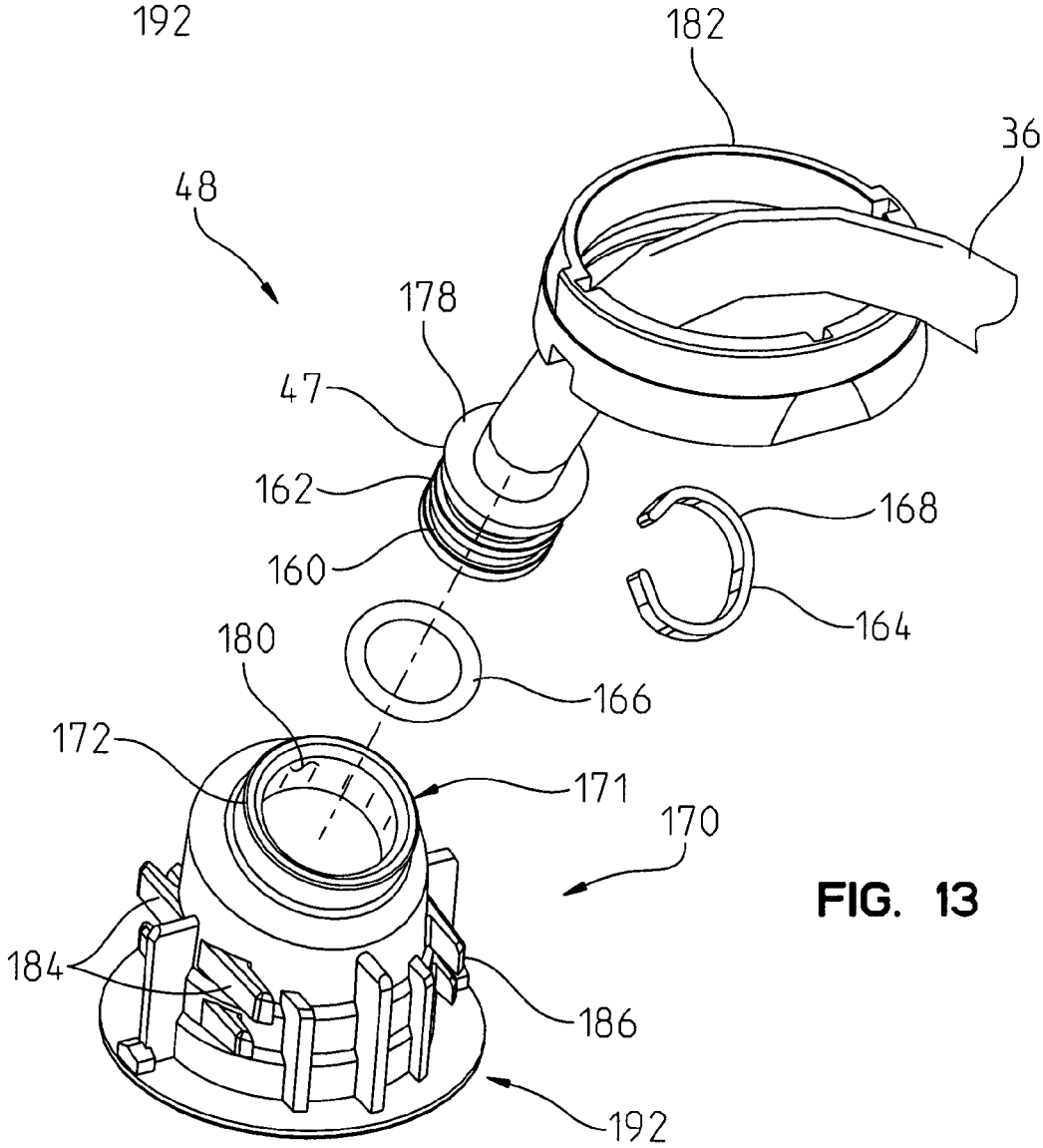
FIG. 13 is an exploded perspective view of the outlet coupling of FIG. 11.

Referring now to FIGS. 2, and 11-13, the tip 47 of the outlet conduit 36 may be overmolded thereto. The tip 47 illustratively includes a pair of annular grooves 160 and 162 sized to receive a retaining clip 164 and a sealing ring 166, respectively. The clip 164 illustratively includes a substantially C-shaped body 168 formed of a polymer, such as a polysulfone. In a naturally expanded position, the clip 164 may be received with annular groove 162 of the tip 47 and extend beyond the outer periphery of the tip 47 (FIG. 11). More particularly, in the expanded position, the clip 164 extends radially outwardly to secure the tip 47 within an adapter 170. The adapter 170 illustratively includes an inlet end 171 supporting a receiving bore 172 having distal and proximal surfaces 174 and 176. The distal surface 174 is configured to engage the retaining clip 164 while the proximal surface 176 is configured to engage an annular flange 178 formed in the tip 47 of the outlet conduit 36. As such, the tip 47 is restrained intermediate the opposing surfaces 174 and 176 of the adapter 170. The sealing ring 166 may be an elastomeric o-ring to provide a seal between the tip 47 of the conduit 36 and an inner surface 180 of the receiving bore 172. Illustratively, the adapter 170 is formed of a polymer, such as the acetal copolymer Celcon®. Additional details on illustrative outlet conduit couplings are shown in U.S. patent application Ser. No. 12/237,811, filed Sep. 25, 2008, the disclosure of which is expressly incorporated by reference herein.

The adapter 170 is illustratively received within an insert 182 that may be formed of a metal, such as brass, and brazed within the outlet end 46 of the tubular body 40 of the spout 16. The adapter 170 illustratively includes first and second pairs of resilient arms 184 and 186 which are configured to be biased radially inwardly within the insert 182 during assembly, and then secure the adapter 170 relative to the insert 182 when expanded back to a natural state. A conventional aerator 190 may be threadably received within an outlet end 192 of the adapter 170.

During assembly of the spout mounting assembly 15, the mounting hub 52 is coupled to the spout 16 by first inserting the retaining member 54 into the tubular body 78 of the mounting hub 52. As the retaining member 54 is moved axially toward the first or lower end 82 of the mounting hub 52, the arms 104 of the first resilient coupler 100 move inwardly over the ramp surface 114 until the retaining lips 108 engage the locking ridge 116. In other words, the retaining member 54 snaps into the mounting hub 52. Next, the o-ring 68 is coupled to the mounting member 50 which is then threaded into the insert 62 of the spout 16.

The biasing member 56 is then assembled to the second or upper end 84 of the mounting hub 52. The spout 16 is then assembled such that the mounting member 50 passes down through the biasing member 56 and inside the mounting hub 52. As the mounting member 50 is moved axially toward the first or lower end 94 of the mounting hub 52, the arms 104 of the second resilient coupler 102 move inwardly over the ramp surface 118 until the retaining lips 108 engage the locking ridge 120. In other words, the retaining member 54 snaps into the mounting member 50.

The spout mounting assembly 15 is then coupled to the mounting deck 12. The tubular body 78 of the mounting hub 52 is passed through the base 91, which is illustratively keyed thereto. Next the tubular body 78 is passed through an opening of the mounting deck 12. The mounting nut assembly 86 is then rotated along threads 85 to secure the mounting hub 52 to the mounting deck 12. The jack screws 88 may be tightened as desired to provide additional clamping force.

Although the invention has been described in detail with reference to certain preferred embodiments, variations and modifications exist within the spirit and scope of the invention as described and defined in the following claims.

The invention claimed is:

1. A spout mounting assembly comprising:
a mounting hub defining a longitudinal axis;
a spout supported for rotation relative to the mounting hub;
a retaining member operably coupled to the spout and the mounting hub, the retaining member configured to restrain axial movement of the spout relative to the mounting hub; and
a biasing member operably coupled to the spout and the mounting hub, the biasing member configured to provide an axial load between the spout and the mounting hub for biasing the spout away from the mounting hub within a dimensional tolerance range of the spout mounting assembly, wherein the retaining member is axially compliant for accommodating the axial load provided by the biasing member.

2. The spout mounting assembly of claim 1, wherein the mounting hub includes a tubular mounting shank, and the spout includes a tubular mounting member received within the mounting shank.

3. The spout mounting assembly of claim 2, further comprising a mounting nut, wherein the tubular mounting shank includes a plurality of external threads configured to operably couple with the mounting nut to secure the spout to a mounting deck.

4. The spout mounting assembly of claim 1, wherein the retaining member includes opposing first and second ends, a first resilient coupler supported at the first end and configured to releasably couple with the mounting hub, and a second resilient coupler supported at the second end and configured to releasably couple with the spout.

5. The spout mounting assembly of claim 4, wherein:

the mounting hub includes a tubular mounting shank having an inner cavity with a retaining ridge;

the spout includes a tubular mounting member received within the mounting shank and including an inner passageway with a retaining ridge;

the first resilient coupler includes an arm including a retaining lip radially biased into engagement with the retaining ridge of the mounting hub; and the second resilient coupler includes an arm including a retaining lip radially biased into engagement with the retaining ridge of the mounting member of the spout.

6. The spout mounting assembly of claim 1, wherein the mounting hub and the spout including opposing engagement surfaces extending substantially perpendicularly to the longitudinal axis, and the biasing member includes a body portion supporting at least one resilient arm extending between the engagement surface of the mounting hub and the engagement surface of the spout.

7. The spout mounting assembly of claim 6, wherein the body portion of the biasing member comprises an annular ring supported by the mounting hub, and the at least one resilient arm is positioned radially inwardly from the annular ring.

8. The spout mounting assembly of claim 1, further comprising a limit member supported by the mounting hub, and a stop member supported by the spout and configured to engage the limit member when the spout is rotated about the longitudinal axis.

9. The spout mounting assembly of claim 1, further comprising a tube extending within a passageway of the spout, and a outlet coupler configured to secure the tube to an outlet end of the spout.

10. A spout mounting assembly comprising:

a mounting hub defining a longitudinal axis;

a spout supported for rotation relative to the mounting hub, the spout including a passageway extending between an inlet end and an outlet end, and a mounting member at the inlet end;

a retaining member operably coupled to the mounting member of the spout and the mounting hub, the retaining member extends between the spout and the mounting hub and is positioned within the mounting hub, the retaining member being configured to restrain axial movement of the spout relative to the mounting hub;

wherein the retaining member includes opposing first and second ends, a first resilient coupler supported at the first end and configured to releasably couple with the mounting hub, and a second resilient coupler supported at the second end and configured to releasably couple with the mounting member of the spout; and wherein the mounting hub includes a tubular mounting shank, and the mounting member of the spout includes a tubular member received within the mounting shank.

11. The spout mounting assembly of claim 10, further comprising a biasing member operably coupled to the mounting hub and configured to provide an axial load between the spout and the mounting hub.

12. The spout mounting assembly of claim 11, wherein the retaining member is axially compliant for accommodating the axial load provided by the biasing member.

13. The spout mounting assembly of claim 11, wherein the mounting hub and the mounting member of the spout include opposing engagement surfaces extending substantially perpendicularly to the longitudinal axis, and the biasing member includes a body portion supporting at least one resilient arm extending between the engagement surface of the mounting hub and the engagement surface of the mounting member of the spout.

14. The spout mounting assembly of claim 13, wherein the body portion of the biasing member comprises an annular ring supported by the mounting hub, and the at least one resilient arm is positioned radially inwardly from the annular ring.

15. The spout mounting assembly of claim 10, further comprising a mounting nut, wherein the tubular mounting shank includes a plurality of external threads configured to operably couple with the mounting nut to secure the spout to a mounting deck.

16. A spout mounting assembly comprising:

a mounting hub defining a longitudinal axis;

a spout supported for rotation relative to the mounting hub, the spout including a passageway extending between an inlet end and an outlet end, and a mounting member at the inlet end;

a retaining member operably coupled to the mounting member of the spout and the mounting hub, the retaining member extends between the spout and the mounting hub and is positioned within the mounting hub, the retaining member being configured to restrain axial movement of the spout relative to the mounting hub;

wherein the retaining member includes opposing first and second ends, a first resilient coupler supported at the first end and configured to releasably couple with the mounting hub, and a second resilient coupler supported at the second end and configured to releasably couple with the mounting member of the spout;

the mounting hub includes a tubular mounting shank having an inner cavity with a retaining ridge;

the mounting member of the spout includes a tubular member received within the mounting shank and including an inner passageway with a retaining ridge;

the first resilient coupler includes an arm including a retaining lip radially biased into engagement with the retaining ridge of the mounting hub; and the second resilient coupler includes an arm including a retaining lip radially biased into engagement with the retaining ridge of the mounting member of the spout.

17. A spout mounting assembly comprising a mounting hub defining a longitudinal axis;

a spout supported for rotation relative to the mounting hub, the spout including a passageway extending between an inlet end and an outlet end, and a mounting member at the inlet end;

a retaining member operably coupled to the mounting member of the spout and the mounting hub, the retaining member extends between the spout and the mounting hub and is positioned within the mounting hub, the retaining member being configured to restrain axial movement of the spout relative to the mounting hub;

wherein the retaining member includes opposing first and second ends, a first resilient coupler supported at the first end and configured to releasably couple with the mounting hub, and a second resilient coupler supported at the second end and configured to releasably couple with the mounting member of the spout; and a limit member supported by the mounting hub, and a stop member supported by the spout and configured to engage the limit member when the spout is rotated about the longitudinal axis.

18. The spout mounting assembly of claim 10, further comprising a tube extending within the passageway of the spout, and a outlet coupler configured to secure the tube to the outlet end of the spout.

19. A spout mounting assembly comprising:

a mounting hub defining a longitudinal axis;

a spout supported for rotation relative to the mounting hub;

a biasing member operably coupled to the spout and the mounting hub, the biasing member configured to provide an axial load between the spout and the mounting hub; and wherein the mounting hub and the spout include opposing engagement surfaces extending substantially perpendicularly to the longitudinal axis, and the biasing member includes a body portion supporting at least one resilient arm extending between the engagement surface of the mounting hub and the engagement surface of the spout.

20. The spout mounting assembly of claim 19, wherein the body portion of the biasing member comprises an annular ring supported by the mounting hub, and the at least one resilient arm is positioned radially inwardly from the annular ring.

21. The spout mounting assembly of claim 19, further comprising a retaining member operably coupled to the spout and the mounting hub, the retaining member configured to restrain axial movement of the spout relative to the mounting hub.

22. The spout mounting assembly of claim 21, wherein the retaining member is axially compliant for accommodating the axial load provided by the biasing member.

23. The spout mounting assembly of claim 19, wherein the mounting hub includes a tubular mounting shank, and the spout includes a tubular mounting member received within the mounting shank.

24. The spout mounting assembly of claim 23, further comprising a mounting nut, wherein the tubular mounting shank includes a plurality of external threads configured to operably couple with the mounting nut to secure the spout to a mounting deck.

25. The spout mounting assembly of claim 19, wherein the retaining member includes opposing first and second ends, a first resilient coupler supported at the first end and configured to releasably couple with the mounting hub, and a second resilient coupler supported at the second end and configured to releasably couple with the spout.

26. The spout mounting assembly of claim 25, wherein:

the mounting hub includes a tubular mounting shank having an inner cavity with a retaining ridge;

the spout includes a tubular mounting member received within the mounting shank and including an inner passageway with a retaining ridge;

the first resilient coupler includes an arm including a retaining lip radially biased into engagement with the retaining ridge of the mounting hub; and the second resilient coupler includes an arm including a retaining lip radially biased into engagement with the retaining ridge of the mounting member of the spout.

27. The spout mounting assembly of claim 19, further comprising a limit member supported by the mounting hub, and a stop member supported by the spout and configured to engage the limit member when the spout is rotated about the longitudinal axis.

28. The spout mounting assembly of claim 19, further comprising a tube extending within a passageway of the spout, and a outlet coupler configured to secure the tube to an outlet end of the spout.

* * * * *